United States Patent [19]

Cerny

[11] Patent Number: 4,972,996

[45] Date of Patent: Nov. 27, 1990

[54] DUAL LIFT ELECTROMAGNETIC FUEL INJECTOR

[75] Inventor: Mark S. Cerny, Sterling Heights, Mich.

[73] Assignee: Siemens-Bendix Automotive Electronics L.P., Troy, Mich.

[21] Appl. No.: 428,564

[22] Filed: Oct. 30, 1989

[51] Int. Cl.[5] ..... F02M 51/00

[52] U.S. Cl. ..... 239/585; 251/129.1

[58] Field of Search ..... 239/585; 251/129.1, 251/129.18

[56] References Cited

U.S. PATENT DOCUMENTS

| | | | |
|---|---|---|---|
| 2,901,210 | 8/1959 | Hebard | 251/129.1 |
| 4,342,443 | 8/1982 | Wakeman | 239/585 |
| 4,361,309 | 11/1982 | Sogabe | 251/129.08 |

FOREIGN PATENT DOCUMENTS

| | | | |
|---|---|---|---|
| 2237746 | 2/1974 | Fed. Rep. of Germany | 239/585 |

*Primary Examiner*—Andres Kashnikow
*Assistant Examiner*—Karen B. Merritt
*Attorney, Agent, or Firm*—George L. Boller; Russel C. Wells

[57] ABSTRACT

The dynamic range of an electromagnetic fuel injector is extended by means of a second solenoid coil that controls the position of a stop for the reciprocating armature that is operated by the usual solenoid coil.

2 Claims, 1 Drawing Sheet

DUAL LIFT ELECTROMAGNETIC FUEL INJECTOR

BACKGROUND AND SUMMARY OF THE INVENTION

This invention relates to electromagnetic fuel injectors of the type that are used for injecting fuel into internal combustion engines.

The typical electromagnetic fuel injector is a lift sensitive device; in other words, the amountof fuel that is injected in response to a given pulse applied to the injector is related to the length of armature travel, i.e. lift. The greater the lift, the greater the amount of fuel injected for a given pulse width.

The timing of injection is usually a very important consideration in a fuel injection system, and because of wide-ranging fuel demands that can be imposed by an internal combustion engine, it is desirable for an electromagnetic fuel injector to have a suitable dynamic range. Dynamic range can be defined as the ratio of fuel flow at the maximum allowable pulse width to the fuel flow at the minmum operational pulse width, and pulse width as the length of time for which the injector is electrically held open. An injector that has a suitable dynamic range must be capable of delivering precise amounts of fuel in the range of engine speeds extending from idle to wide open throttle. At idle, a small amount of fuel must be precisely delivered, while at high speeds and loads, a larger amount of fuel must be precisely delivered. As engine speed increases, the time window within which fuel can be injected narrows, and therefore, a fuel injector must have a wide dynamic range in order to accommodate all engine operating conditions. The fuel injection task is particularly demanding in the case of a two-cycle engine.

One possible solution to meeting the wide range of engine demnand would be to use two injectors to span the range, one covering a lower portion of the range, and the other covering an upper portion. Disadvantages of such a solution include the need for extra parts and assembly. A preferred solution therefore is to use a single injector, and it is toward this objective that the present invention is directed.

Briefly, the invention comprises a fuel injector having a dual lift capability that endows the device with a wide dynamic range; for example ranges of up to 20:1 and 30:1 are contemplated. The lift of the injector is controlled by a second solenoid coil that is additional to the usual solenoid coil via which the injector is pulsed. When this second solenoid is not energized, the injector operates with lesser lift, but when it is energized, the injector operates with greater lift. The injector of the invention is characterized by an oganization and arrangement of component parts that are conducive to assembly, adjustment, and functional requirements.

Additional features, advantages, and benefits of the invention will also be seen in the accompanying drawing which discloses a presently preferred embodiment of the invention according to the best mode contemplated at this time for carrying out the invention.

DESCRIPTION OF THE PREFERRED EMBODIMENT

Figure 1:
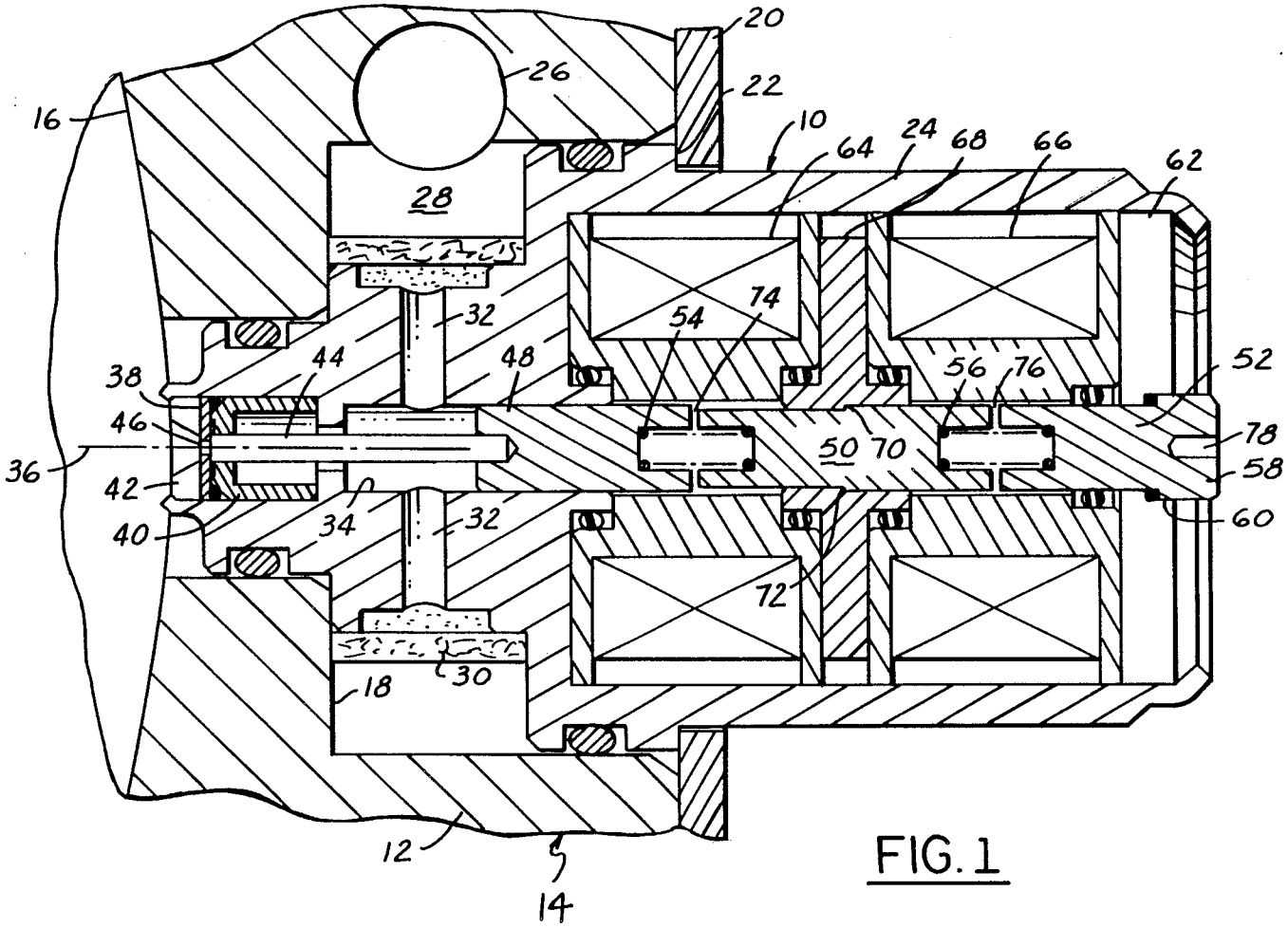
FIG. 1 is a longitudinal cross sectional view through a dual lift electromagnetic fuel injector according to the invention illustrating an engine mounting.

The injector 10 is mounted on the block 12 of an engine 14 and injects liquid fuel directly into a combustion chamber 16 of the engine. The injector is disposed in a sealed manner in a shouldered hole 18 that extends through the wall of the block. An apertured keeper plate 20 that is fastened to the block bears against a shoulder 22 on the body 24 of the injector to keep the injector in hole 18.

A fuel passage 26 that supplies pressure regulated liquid fuel to the injector intercepts hole 18. Fuel fills the annular space 28 surrounding the injector so as to be presented to the outer surface of a circular filter 30 that is disposed in covering relation over radial passages 32 in the injector body. Passages 32 end at a longitudinally extending passage 34 that is coaxial with the main axis 36 of the injector. Fuel from passage 26 is thereby supplied to passage 34.

The end of passage 34 that is toward cylinder 16 contains a thin orifice disc 38 that is sandwiched between a needle guide member 40 and a retainer member 42. A cylindircal needle 44 coacts with a circular orifice 46 in disc 38 for the purpose of opening and closing orifice 46. The drawing Figure illustrates the neddle closing the orifice so that flow of liquid fuel from passage 34 into cylinder 16 is blocked. When the needle is displaced away from the disc, the orifice is opened allowing fuel to pass through the orifice and be injected into the cylinder. The small hole in member 40 through which the needle passes serves to guide the distal end of the needle.

Needle 44 is displaced coaxially along axis 36 by means of a cylindrical armature 48 that is disposed within passage 34. The end of needle 44 that is opposite disc 38 is suitably joined to the near end of armature 48 so that the two move in unison. Beyond armature 48 is a further cylindrical armature 50, and beyond armature 50 is a stator 52, these parts also being coaxial with axis 36. A helical spring 54 is disposed between aramature 48 and armature 50 while a helical spring 56 is disposed between armature 50 and stator 52. The ends of the springs are seated in respective bores in the ends of the parts 48, 50, 52.

Stator 52 has a head 58 that is threaded into a threaded hole 60 in a circular plate 62 that closes the far end of the injector body. Plate 62 serves to capture within the injector body two coaxially aligned solenoid coil assemblies 64, 66 that are separated by a spacer 68. The three parts 64, 66, 68 are annular in shape so as to form a continuation of passage 34.

The drawing Figure shows the condition of both solenoid assemblies being de-energized. For this condition, spring 56 reacts against stator 52 to force armature 50 toward armature 48 such that a shoulder 70 on armature 50 is pressed against a shoulder 72 on spacer 68. In this way the spacer forms a limit stop for armature 50. Spring 54 reacts against armature 50 to force needle 44 into closure of orifice 46. Consequently, fuel cannot be emitted from the injector into the engine cylinder when both solenoid assemblies are de-energized.

The application of a pulse waveform to solenoid assembly 64 causes armature 48 and needle 44 to reciprocate between the position that is shown in the Figure and a position where armature 48 abuts armature 50. This reciprocation causes fuel to be emitted from the injector into the cylinder. The flow rate is controlled by modulating the pulse width of the waveform applied to solenoid assembly 64.

Armature 50 is however positionable within the injector to control the distance over which armature 48 and needle 44 reciprocate when solenoid assembly 64 is pulsed. With solenoid assembly 66 de-energized, armature 48 and needle 44 can reciprocate a distance equal to the axial dimension of the gap 74 in the Figure. With solenoid assembly 66 energized armature 50 is retaracted against stator 52 so that armature 48 and needle 44 can reciprocate a distance equal to the sum of the axial dimension of gap 74 and the axial dimension of the gap 76 in the Figure. Accordingly, the injector lift is less when solenoid assembly 66 is de-energized, and it is more when solenoid assembly 66 is engergized. It is in this way that the dynamic range of the injector is extended.

When fuel demand is in a lower portion of the demand range, solenoid assembly 66 is de-energized, and the modulation of the pulse waveform applied to solenoid coil 64 varies the fuel delivery rate within this portion of the range. When fuel demand is in a higher portion of the demand range, solenoid assembly 66 is energized by a continuous low level current, and the modulation of the pulse waveform applied to solenoid coil 64 varies the fuel delivery within this higher portion of the range.

The fuel injector provides convenient calibration because stator can be axially adjusted by screwing it either more or less into hole 60. Such adjustment is performed by means of a tool (not shown) which can be inserted into a complementary shaped socket 78 in the exterior of stator head 58.

The component parts of the assembly are designed by the use of conventional engineering procedures and are fabricated from conventional materials using conventional manufacturing techniques.

What is claimed is:

1. An extended dynamic range fuel injector for an internal combustion engine comprising an injector body having a main longitudinal axis, a liquid fuel inlet in said body via which pressure-regulated liquid fuel enters the interior of said body, orifice means at a longitudinal end of said body via which fuel is emitted from the interior of said body, a valve member that is arranged coaxially with said body for displacement along said axis to open and close said orifice means, a solenoid coil bounding a passage that is coaxial with said axis, an armature that is disposed within said passage and connects to said valve member, a further armature that is disposed within said passage beyond said first-mentioned armature, a spring acting between said two armatures to urge said first-metioned armature away from said further armature and said valve member toward closure of said orifice means, a further solenoid coil bounding said passage beyond the first-mentioned solenoid coil, a stator disposed within said passage beyond said further armature and affixed to said body, a further spring acting between said stator and said further armature to urge said further armature away from said stator and against a limit stop that is within said passage and limits the displacement of said further armature away from said stator, and wherein said solenoid coils, said armatures, said springs and said stator are arranged such that said first-mentioned armature is under the control of said first-mentioned solenoid coil to be displaced away from said orifice means and cause said valve member to open said orifice means when said first-mentioned solenoid coil is energized and to be returned by said first-mentioned spring toward said orifice means and close said orifice means when said first-mentioned coil is de-energized, and said further armature forms a selectively positionable stop for said first-mentioned armature to limit the displacement thereof away from said orifice means when said first-mentioned solenoid coil is energized, said further armature being under the control of said further solenoid coil such that when said further solenoid coil is energized, said further armature is displaced away from said limit stop to abut said stator and thereby allow the maximum displacement of said first-mentioned armature when said first-mentioned solenoid coil is energized, and when said further solenoid coil is de-energized, said further spring forces said further armature against said limit stop to allow only smaller displacement of said first-mentioned armature when said first-metioned solenoid coil is energized.

2. A fuel injector as set forth in claim 1 wherein said stator is postionable on said body to establish the extent to which said further armature can be displaced from said limit stop when said further solenoid coil is energized.

* * * * *